US005390570A

United States Patent [19]

Reisner

[11] Patent Number: 5,390,570

[45] Date of Patent: Feb. 21, 1995

[54] ADJUSTABLE WRENCH FOR OIL AND FUEL FILTERS

[76] Inventor: Edward J. Reisner, 39311 Ferris, Clinton Township, Macomb County, Mich. 48036

[21] Appl. No.: 177,222

[22] Filed: Jan. 4, 1994

[51] Int. Cl.[6] ..... B25B 13/52

[52] U.S. Cl. ..... 81/64; 81/3.43

[58] Field of Search ..... 81/3.43, 64, 65, 65.2

[56] References Cited

U.S. PATENT DOCUMENTS

| | | | |
|---|---|---|---|
| 1,389,011 | 8/1921 | Quinn | 81/64 X |
| 2,181,012 | 11/1939 | Bunting | 81/64 |
| 2,834,238 | 5/1958 | Stover, Sr. | 81/64 |
| 3,064,325 | 11/1962 | Nester | 81/64 X |
| 3,728,916 | 4/1973 | Brantley | 81/64 |
| 3,962,936 | 6/1976 | Lewis | 81/64 |
| 4,221,140 | 9/1980 | Bracey et al. | 81/64 |
| 4,249,296 | 2/1981 | Colburn | 29/426.1 |
| 4,345,494 | 8/1982 | Aamodt | 81/64 |
| 4,506,568 | 3/1985 | Aamodt | 81/64 |
| 4,646,593 | 3/1987 | Robertson | 81/64 |
| 4,848,192 | 7/1989 | Jeffreys | 81/64 |
| 4,860,617 | 8/1989 | Robbins | 81/64 |
| 4,987,804 | 1/1991 | Greenawalt | 81/64 |

FOREIGN PATENT DOCUMENTS

| | | | |
|---|---|---|---|
| 2161408 | 1/1986 | United Kingdom | 81/64 |

*Primary Examiner*—D. S. Meislin

*Attorney, Agent, or Firm*—Pennie & Edmonds

[57] ABSTRACT

An improved oil and fuel filter removing wrench that is adjustable to fit almost any cylindrical oil and fuel filter on cars, trucks, and heavy equipment. The wrench includes a toothed belt that grabs the filter and applies torque in combination with a handle and sleeve. One end of the belt is free for adjustment of the length which is used to engage the filter, and the sleeve is used to hold the belt securely in place on the handle. Additional leverage is supplied by a lever arm which projects from the sleeve. The belt is adjusted to fit snugly on the filter and does not require the user to do any additional work after it is applied to the filter. Due to the wide range of filter sizes that it can accommodate, the wrench is convenient and practical and eliminates the need for multiple wrenches or more complicated devices.

18 Claims, 1 Drawing Sheet

ADJUSTABLE WRENCH FOR OIL AND FUEL FILTERS

FIELD OF THE INVENTION

The present invention relates to an apparatus for the removal of oil and fuel filters from cars, light and heavy trucks, and heavy equipment.

BACKGROUND ART

Many special purpose wrenches are known for removing cylindrical oil filters. Most of these employ a rigid metal band which conforms to the outer circumference of the filter. As pressure is applied to the handle, the band tightens around the filter and imparts a force which twists the filter for removal. Since the metal band is smooth, it often tends to slide around the filter rather than twist it. When additional pressure or force is applied, the band often tends to bend the filter out of shape, thus ruining the filter and making that wrench useless for removing the filter.

Thus, flexible straps were substituted for the metal band in an attempt to improve the performance of the wrench (See, e.g., U.S. Pat. Nos. 3,728,916, 3,962,936, 4,249,245, 4,345,494 and 4,860,617). Since the strap would tend to stretch much more than metal, these wrenches would be ineffective unless some mechanism is provided to compensate for the greater amount of stretch of the flexible strap.

Current adjustable flexible strap wrenches are often in need of other tools for proper usage, causing more expense to the consumer. Others are complicated and take up space in small areas, such as engine compartments, where room is limited. The devices of U.S. Pat. Nos. 4,221,140, 4,506,568 and 4,646,593 need additional tools for proper usage, thus producing a more complicated and expensive tool. In addition, these wrenches do not apply the torque quickly and directly to the object, because the strap must rotate at least partially around a shaft before tightening, which often causes slippage. U.S. Pat. No. 4,848,192 requires a relatively larger space to apply the wrench to the filter because the lever is offset from the strap. Thus, the user must pull the strap back and then apply force to the lever to lock the strap in place. This must be done before pressure can be applied to remove the filter. After extended use, the handle can cut the strap and require replacement.

The present invention provides a simpler, more durable, more effective tool that is relatively inexpensive, takes up a small amount of space in a tool box, and does not require other objects for use.

SUMMARY OF THE INVENTION

The invention specifically relates to an adjustable oil and fuel filter wrench comprising a belt having first and second ends and a plurality of teeth on one side thereof, a handle member having a toothed end for engaging the teeth of the belt and a handle portion for grasping by the user, and a coupling member for coupling the belt teeth with the toothed end of the handle member. The coupling member is moveable between a first position where the belt is retained in engagement with the toothed end of the handle member and a second position wherein at least one end of the belt can be moved to adjust the length of the belt, thus enabling the wrench to be used for filters of different diameter sizes.

Preferably, the handle member includes stop means for retaining the coupling member in the first position, and the first end of the belt is fastened to the handle member while the second end is free. It is advantageous for the toothed end of the handle member to include a plurality of teeth for engaging the teeth of at least the second end of the belt.

The handle member preferably has first and second opposed sides with the first end of the belt secured to the first side and the plurality of teeth located on the second side for engaging the teeth of the second end of the belt. If desired, teeth can be provided on both sides of the handle member for engaging the teeth on each end of the belt. The coupling member thus has at least first and second side portions for applying forces to compress the ends of the belt against the first and second sides of the handle member. Specifically, the coupling member comprises a four sided tube having an internal perimeter which is only slightly greater than that of the belt ends and handle member so that a snug fit is obtained when it is placed in the first position.

If desired, the coupling member may include a lever arm to provide leverage for removing filters. This lever arm may comprise first and second extensions oriented at an angle, preferably of substantially 90°. A preferred shape for the handle member is a square tube.

DETAILED DESCRIPTION OF THE INVENTION

Figure 1:
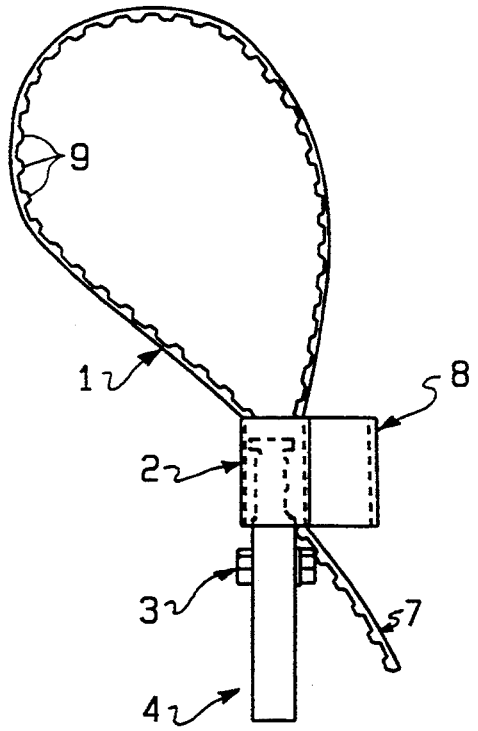
FIG. 1 is a front view of the device in accordance with the present invention, as it would be ready for use.
Figure 2:
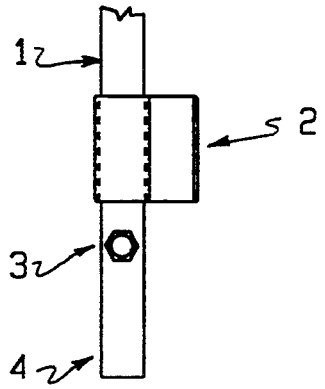
FIG. 2 is a side view of the device of FIG. 1.
Figure 3:
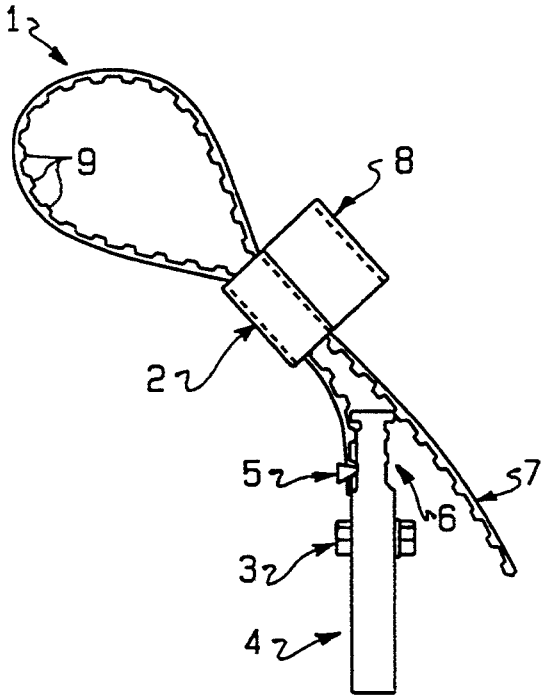
FIG. 3 and 4 are front and partial perspective views of the device of FIG. 1 with the locking arm in the up position and ready for adjustment of the belt.
Figure 4:
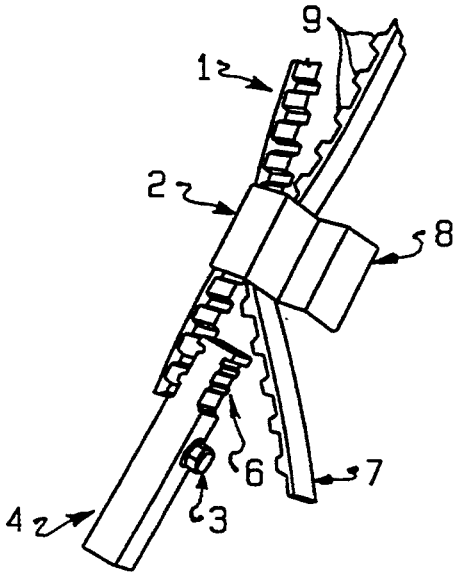

The principal object of the present invention is to provide an oil and fuel filter wrench that may be used on a wide variety of filter sizes. The wrench utilizes a toothed friction belt for added gripping of the filter. The belt is attached directly to the handle member for immediate removal of the filter when force is applied to the wrench.

Generally, the applied torque can be increased by providing a protruding lever arm that rests against the filter. The lever arm is attached to a coupling member which is preferably made of square tubing that is used to hold the belt against the handle member. The tubing is prevented from moving away from the filter by a bolt in the handle member, which bolt has a greater length than the width of the coupling member. These features combine to form a simple but effective, adjustable wrench.

As shown in the drawings, the preferred filter wrench of the present invention includes a belt, 1 the length of which can be adjusted to the desired size through the use of a coupling member or sleeve 2, and a solid handle member 4. The handle member 4 is preferably made of steel and has teeth notched out in the top portion 6. One end of the belt 1 is affixed to the handle member 4 through the use of a rivet 5, screw, bolt or other fastening means. If desired, that end of the belt 1 can be extended so that it is secured to the handle member 4 by bolt 3. It is preferable for the belt to be attached to the handle member 4 in the area where the teeth are cut out of the handle member 4 to minimize the inner peripheral size of the sleeve 2. The opposite end 7 of belt 1 is free so that the length which engages the filter can be adjusted. Bolt 3, or another protruding object, is used as a stop member to retain the sleeve 2 in its proper position.

The sleeve 2 has a lever arm 8 that extends away at a 90-degree angle to provide leverage. Lever arm 8 is preferably an L-shaped section which extends from the coupling member 2. Advantageously, lever arm 8 is integral with the coupling member 2 and both are made by bending a steel strip into a square tube that has an L-shaped extension. If desired, the tube can be welded to resist separation, or the L-shaped extension can be welded to a seamless square tube. Alternatively, the coupling member 2 and lever arm 8 can be made of an aluminum extrusion which is cut to the desired length. Typical sizes for these components are given below.

The belt 1 includes teeth 9 for extra grabbing action on the filter as well as to hold the belt 1 firmly in place against the handle member 4. The toothed portion 6 of the handle member 4 is engaged on both sides by the toothed belt 1. As noted above, one end of the belt 1 is affixed to the handle member 4, and the belt teeth on that end engage the teeth on one side of the handle member 4 to reduce the amount of stress or force on the rivet 5. The other end 7 of the belt 1 is placed against the other side of the handle member so that the handle teeth engage the belt teeth to prevent slippage of the belt. The sleeve 2 is placed over the belt 1 and handle member 4 to retain the teeth in engagement during use of the wrench.

In operation, the length of the belt 1 is easily adjusted by sliding the sleeve 2 away from the handle member 4 and then pulling the free end 7 of the belt 1 toward the handle member 4 until the opening formed by the belt 1 corresponds to the desired size of the filter. The belt 1 is firmly locked in place by sliding the sleeve 2 back toward the handle member 4 until it stops in the correct position by contacting bolt 5. The open belt portion of the wrench is then pushed or slid onto the filter and is ready for use.

The basic construction of the device allows it to be adjusted quickly and without slippage. It is preferred to utilize a belt width of approximately one inch (2.54 cm), and a length of about twenty-four inches (60.96 cm). A timing belt for an automobile engine has been found to be the most advantageous belt 1 for this device. The handle member 4 is preferably about five inches (12.7 cm) in length and three-quarters of an inch (1.9 cm) thick. The sleeve 2 is approximately one inch (2.54 cm) wide and one and three-quarter inches (4.45 cm) long, with the lever arm 8 having a twist extension of about three-quarters of an inch (1.9 cm) and a second extension of about three-quarters of an inch (1.9 cm) extending perpendicularly to the first extension. The bolt 5 for preventing movement of the coupling member 2 and for retaining the fixed end of the belt should be about one and one-quarter (3.2 cm) inches long.

While those persons of ordinary skill in the art may make various changes to the specifically preferred features shown and described above, it is considered that all modifications and changes which are within the spirit and scope of the invention shall be covered by the appended claims.

What is claimed is:

1. An adjustable oil and fuel filter wrench comprising:

a belt having a length, a width, first and second ends, and a plurality of teeth on one side thereof, with the teeth being positioned and located in spaced relation along the length of the belt and spanning the width thereof;

a handle member having a toothed end for engaging the teeth of the belt and a handle portion for grasping by the user; and a coupling member being configured and positioned to surround the toothed end of the handle member and the ends of the belt for coupling the teeth of at least the first end of the belt with the toothed end of the handle member, said coupling member being movable between a first position where the first end of the belt is urged toward the handle member to retain the teeth of first end of the belt in engagement with the toothed end of the handle member, and a second position wherein the first end of the belt can be moved to adjust the length of the belt which will contact the filter, thus enabling the wrench to be used for different diameter filters.

2. The wrench of claim 1 wherein the handle member includes stop means for retaining the coupling member in the first position.

3. The wrench of claim 1 wherein the second end of the belt is fastened to the handle member and the first end is free, and wherein the toothed end of the handle member includes a plurality of teeth for engaging the teeth of the first end of the belt.

4. The wrench of claim 1 wherein the handle member has first and second opposed sides with the second end of the belt secured to the first side and the plurality of teeth located on the second side of the handle member for engaging the teeth of the first end of the belt.

5. The wrench of claim 4 wherein the coupling member has at least first and second side portions for applying forces to compress the first and second ends of the belt against the first and second sides of member.

6. An adjustable oil and fuel filter wrench comprising:

a belt having first and second ends and a plurality of teeth on one side thereof;

a handle member having a toothed end for engaging the teeth of the belt and a handle portion for grasping by the user; and a coupling member for coupling at least the teeth of one end of the belt with the toothed end of the handle member, said coupling member being movable between a first position where the belt is retained in engagement with the toothed end of the handle member and a second position wherein at least one end of the belt can be moved to adjust the length of the belt which will contact the filter, thus enabling the wrench to be used for different diameter filters;

wherein the coupling member comprises a four sided tube having an internal perimeter which is only slightly greater than that of the belt ends and handle member so that a snug fit is obtained in the first position.

7. The wrench of claim 1 wherein the coupling member further comprises a lever arm to provide leverage for removing filters.

8. The wrench of claim 7 wherein the lever arm comprises first and second extensions oriented at an angle.

9. The wrench of claim 8 wherein the angle is substantially 90°.

10. The wrench of claim 1 wherein the handle member is made of a square tube, 11. An adjustable oil and fuel filter wrench comprising:

a belt having first and second ends and a plurality of teeth on one side thereof;

a handle member having a toothed end for engaging the teeth of the belt and a handle portion for grasping by the user; and a coupling member for engaging at least the teeth of one end of the belt with the toothed end of the handle member, said coupling member locatable in a first position where the belt is retained in engagement with the toothed end of the handle member;

wherein the handle member has first and second opposed sides and includes means for retaining the coupling member in position, with the first end of the belt secured to the first side of the handle member while the second end is free, the handle member includes at least one tooth on each side and the coupling member urges the belt ends toward engagement with the teeth of the handle member, and the second end of the belt can be moved to adjust the length of the belt which will contact the filter, thus enabling the wrench to be used for different diameter filters.

12. The wrench of claim 11 wherein the coupling member comprises a four sided tube having an internal circumference which is only slightly greater than that of the belt ends and handle member so that the tube applies forces to urge the belt ends toward engagement with the teeth of the handle member sides.

13. The wrench of claim 12 wherein the handle member is made of a square tube.

14. The wrench of claim 13 wherein the coupling member is movable away from the handle portion to facilitate movement of the second belt end and adjustment of the length of the belt.

15. The wrench of claim 11 wherein the teeth of the belt are positioned and located in spaced relation substantially parallel to the first and second ends of the belt.

16. The wrench of claim 15 wherein the coupling member comprises a four sided tube having an internal perimeter which is only slightly greater than that of the belt ends and handle member so that a snug fit is obtained in the first position.

17. The wrench of claim 11 wherein the teeth of the belt are positioned and located in spaced relation substantially parallel to the first and second ends of the belt.

18. The wrench of claim 17 wherein the coupling member comprises a four sided tube having an internal perimeter which is only slightly greater than that of the belt ends and handle member so that a snug fit is obtained in the first position.

* * * * *